United States Patent [19]

LaLonde

[11] Patent Number: 4,492,066

[45] Date of Patent: Jan. 8, 1985

[54] SUSPENSION CEILING GRID SYSTEM

[75] Inventor: Paul D. LaLonde, Avon, Ohio

[73] Assignee: Donn Incorporated, Westlake, Ohio

[21] Appl. No.: 465,249

[22] Filed: Feb. 9, 1983

Related U.S. Application Data

[63] Continuation-in-part of Ser. No. 346,857, Feb. 8, 1982.

[51] Int. Cl.[3] ..... E04C 2/42

[52] U.S. Cl. ..... 52/668; 52/484; 52/489

[58] Field of Search ..... 52/484, 667, 668, 666, 52/489

[56] References Cited

U.S. PATENT DOCUMENTS

| | | | |
|---|---|---|---|
| 3,013,644 | 12/1961 | Smith et al. | 52/666 |
| 3,023,865 | 3/1962 | Brandstetter | 52/484 X |
| 3,501,185 | 3/1970 | Brown et al. | 287/189.36 |
| 3,503,641 | 3/1970 | Fraser | 52/667 X |
| 3,675,957 | 7/1972 | Lickliter et al. | 52/667 X |
| 3,835,614 | 9/1974 | Downing, Jr. | 52/666 |
| 3,996,716 | 12/1976 | Tuten et al. | 52/484 X |
| 4,047,348 | 9/1977 | McSweeney | 52/666 X |
| 4,108,563 | 8/1978 | Brown et al. | 403/347 |
| 4,389,828 | 6/1983 | Cary | 52/665 |

*Primary Examiner*—Carl D. Friedman

*Attorney, Agent, or Firm*—Pearne, Gordon, Sessions, McCoy, Granger & Tilberry

[57] ABSTRACT

A basketweave-type suspension ceiling grid system is disclosed wherein the grid members are generally U-shaped providing a relatively wide face portion, oppositely extending panel support flanges, and a pair of spaced and parallel webs. The system provides a connector system in which the female part of the connector system is provided by a longitudinally extending slot substantially adjacent to the panel support flanges. Male end connector parts are proportioned to fit through the slots and lock therein to the members of the grid. The male connector part provides a generally T-shaped lanced projection which extends rearwardly and upwardly from a hinge line and is formed with raised wing portions providing stop surfaces for engaging the remote side of an associated web. A dimple formed intermediate the rings and rearwardly therefrom provides a stop surface limiting the insertion movement of the connector. The rearwardly extending stem part of the T-shaped lanced projection can be depressed to release the lock surfaces and allow disassembly of the members. In one embodiment, the connector is integrally formed on the runner end, and in another embodiment the end connector is a separate clip which telescopes into the runner.

28 Claims, 9 Drawing Figures

SUSPENSION CEILING GRID SYSTEM

This application is a continuation-in-part of copending application Ser. No. 346,857, filed Feb. 8, 1982.

BACKGROUND OF THE INVENTION

This invention relates generally to suspension ceiling grid systems, and more particularly to a novel and improved grid connector structure for such systems.

Prior Art

Various types of grid connectors for suspension ceiling grid systems are known. Examples of such connectors are illustrated and described in U.S. Pat. Nos. 3,501,185 and 4,108,563. In such systems, the grid members are T-shaped having opposed panel supporting flanges, a central web, and a bulb at the upper extremity of the web. In such systems, the intersecting grid members are connected by vertically extending connectors which interlock either through the web or with the web.

It is also known to provide wide face grid members in which the grid element is generally U-shaped, having two spaced, vertical webs and a relatively wide face portion providing oppositely extending panel-supporting flanges. Examples of such grids are illustrated in U.S. Pat. No. 3,835,614 and in the copending application Ser. No. 232,195, filed Feb. 6, 1981. All of such patents and such application are assigned to the assignee of the present invention.

In the last-cited patent, supra, and the pending application, the central portion of the face is recessed back from the oppositely extending panel support flange. However, it is also known to provide such wide face grid elements with a flat or planar lower face in which the panel support flanges are coplanar with the central portion of the face. It is also known to connect such grid members with separate clips which are inserted through longitudinally extending slots adjacent to the upper edges of webs and which are provided with an upstanding flange which engages the rearward side of the web to secure the grid members together.

SUMMARY OF THE INVENTION

The illustrated embodiments of the present invention provides a novel and improved connector structure for grid systems in which the plane of the connector structure is horizontal and is located substantially adjacent to the plane of the panel support flanges. Such connector structure is illustrated in a grid system constructed from wide-faced grid members having a pair of spaced, vertical webs.

The connector structure includes an end male connector part which extends from the lower face of the grid member and snaps through a horizontal slot in the associated web adjacent to the flanges. The connector provides an upwardly extending projection which is cammed substantially into the connector plane as it is inserted into a mating slot until lock edges or surfaces pass the associated web. Such locking edges then resiliently snap back and lock against the remote side of the web to prevent separation of the connector members. A stop surface immediately behind the locking edges is sized and positioned to limit the insertion movement of the connector into the slot to the proper position for locking.

Release of the connector is provided by depressing the projection, disengaging the locking edges, and then pulling the connector out of the slot. In the illustrated embodiment, the stop surface is provided by a dimple formed in the projection midway between two symmetrically located locking edges.

When the connection between the intersecting grid members is located in a plane substantially along the lower face of the grid elements, the grid system is better able to withstand tensile forces without having the joints therein open up.

In one illustrated embodiment, the connector projection is economically formed from the grid element face material. In another illustrated embodiment, the end connector is a separate piece of metal which is mounted on the end of the runner in a way that facilitates installation or removal of a given runner in an existing grid system.

In the illustrated embodiments, the grid system is a basketweave-type constructed of grid members having similar but opposite connector projections at each end and mating slot openings intermediate their ends. However, this invention may also be applied to main run cross-run type grid systems.

These and other aspects of this invention are illustrated in the accompanying drawings, and are more fully described in the following specification.

DETAILED DESCRIPTION OF THE DRAWINGS

Figure 1:
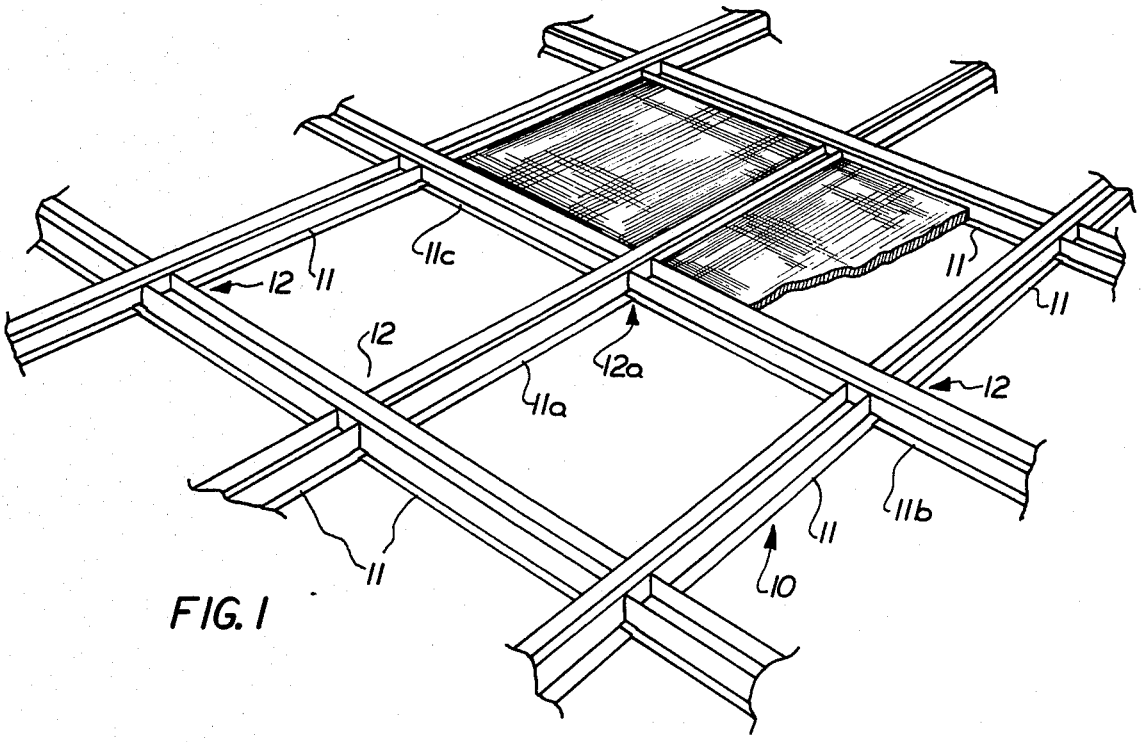
FIG. 1 is a fragmentary, perspective view of a suspension ceiling constructed of grid members in accordance with one embodiment of the present invention.
Figure 2:
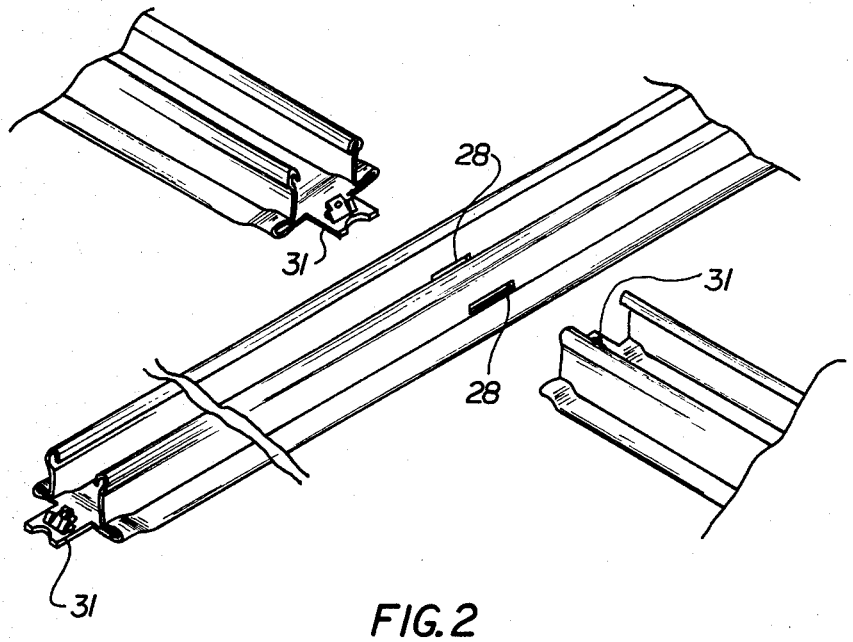
FIG. 2 is a fragmentary, exploded, perspective view of a preferred form of grid connector in accordance with the present invention.

FIG. 1 illustrates a portion of a ceiling structure as viewed from above incorporating a connector system in accordance with a first embodiment of the present invention. In such Figure, the grid members are arranged in a basketweave-type system, and the grid is illustrated with ceiling panels installed in only part of the system. Further in this Figure, the size of the grid members themselves compared to the size of the panel openings is exaggerated for purposes of illustration.

The grid system 10 is constructed of a plurality of similar grid members 11. Each of the grid members 11 is provided with a similar end connector at each end (discussed in detail below) and an end connector receiving slot midway between its ends. The connections interconnect the various grid members at intersections 12.

At each intersection 12, the end connectors of two oppositely extending grid members 11 connect with a perpendicularly extending grid member which extends through the intersection. For example, at the intersection 12*a* illustrated in FIG. 1, the grid member 11*a* extends through the intersection and one end of the grid member 11*b* connects to one side of the grid member 11*a*, while an opposite end of the grid member 11*c* connects to the opposite side of the grid member 11*a*. A similar intersection is provided at each corner of the panel openings illustrated.

Figure 3:
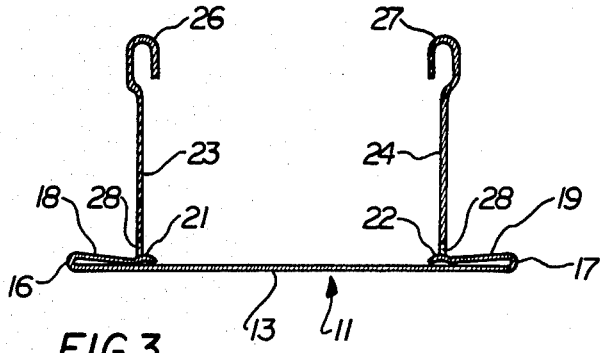
FIG. 3 is a cross section of one of the grid members, taken through the slots therein which receive the male end connectors.
Figure 4:
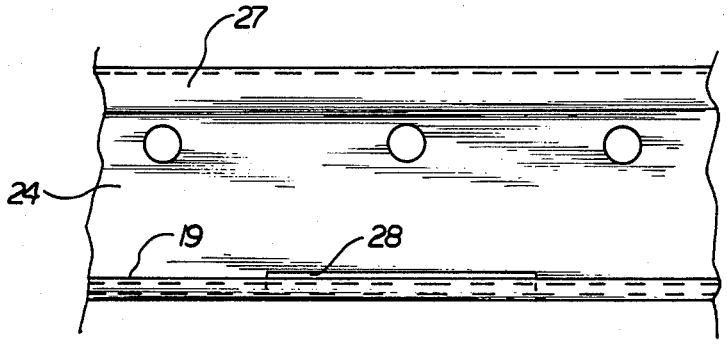
FIG. 4 is a fragmentary side elevation of the grid member illustrated in FIG. 3.
Figure 5:
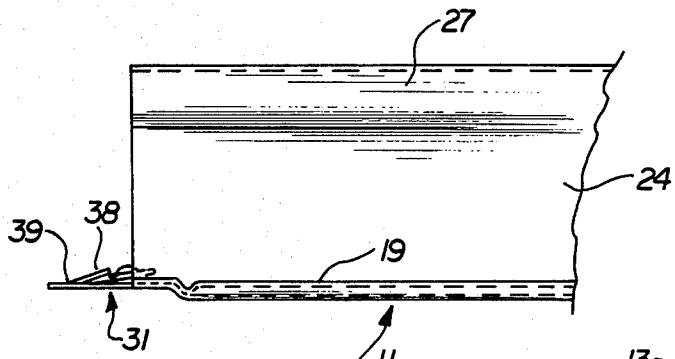
FIG. 5 is a fragmentary side elevation of a grid end illustrating the male end connector.

Referring now to FIGS. 2 through 6, each of the grid members has a cross section as illustrated in FIG. 3. The grid members 11 are formed of elongated strips of metal which are bent to the shape illustrated. Once formed, the metal provides a lower planar face 13 which extends laterally of the grid member to reverse bends 16 and 17. From the reverse bends 16 and 17, the metal extends inwardly substantially parallel to the lower face 13 to provide opposed panel supporting flanges 18 and 19, respectively. The panel supporting flanges end at substantially right-angle bends at 21 and 22, and from such bends the grid provides spaced and opposite vertically extending webs 23 and 24, respectively. The upper ends of the webs 23 and 24 are provided with oppositely facing bulbs 26 and 27. The grid members 11 therefore are generally U-shaped, providing a planar face 13 and oppositely extending panel support flanges.

A female part of the connecting structure is provided by a longitudinally extending slot 28 formed in each of the webs 23 and 24 substantially adjacent to the bends 21 and 22 at the mid-point along the length of the grid member. These slots 28 are proportioned to receive the male portion 31 formed at each end of an associated grid member 11.

Figure 9:
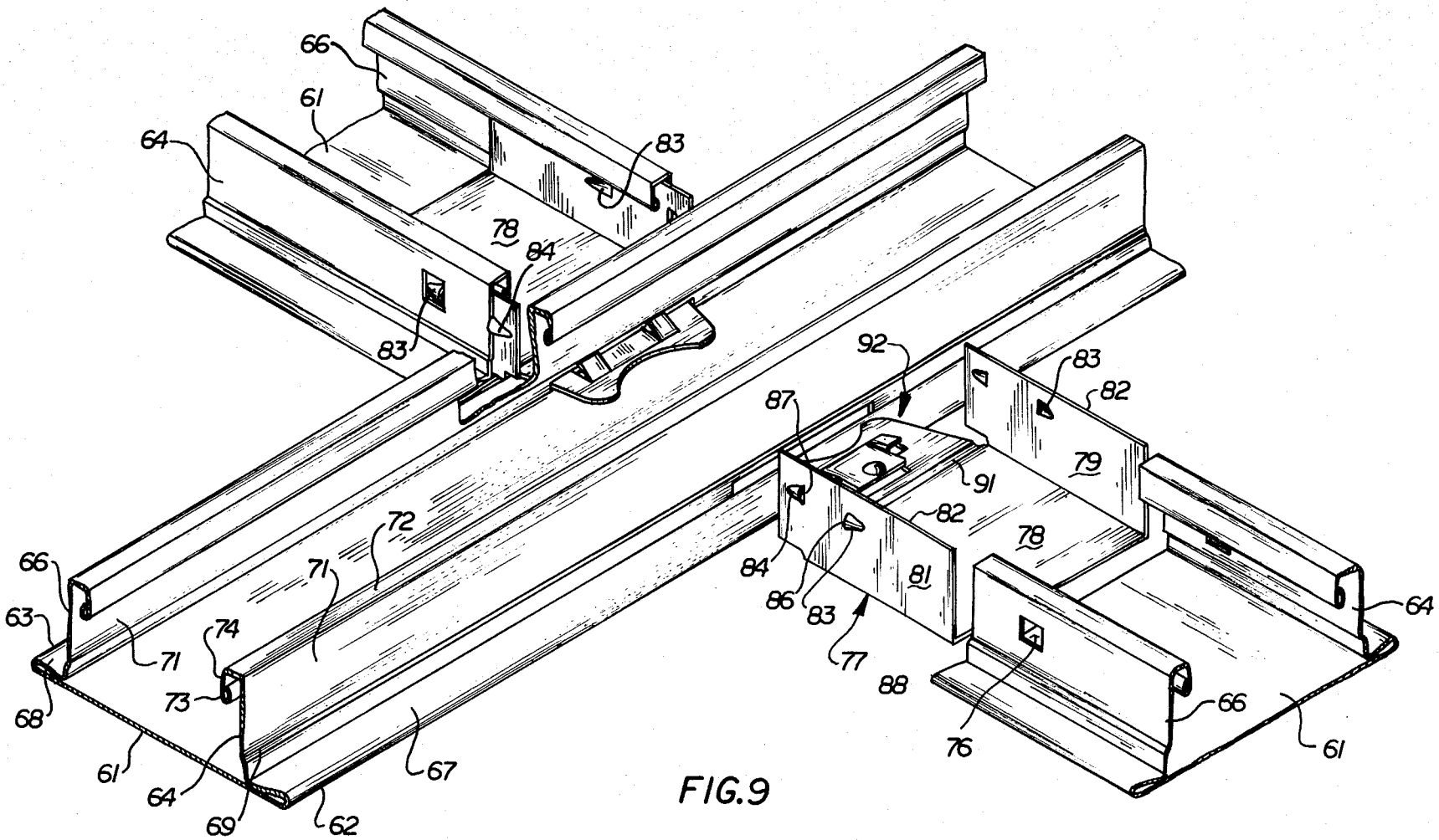
FIG. 9 is an exploded, perspective view illustrating a second embodiment in which the end connector is provided by a separate clip structured to facilitate disassembly of the grid.

In this illustrated embodiment, the male or projecting end connection is formed integrally with the grid member from an extending portion of the material forming the center part of the face 13. However, in its broader aspects, this invention contemplates the provision of male end connectors formed as separate pieces or separate clips which are suitably connected to the ends of the grid members. The second embodiment of FIG. 9 illustrates one such separate end connector structure.

Figure 6:
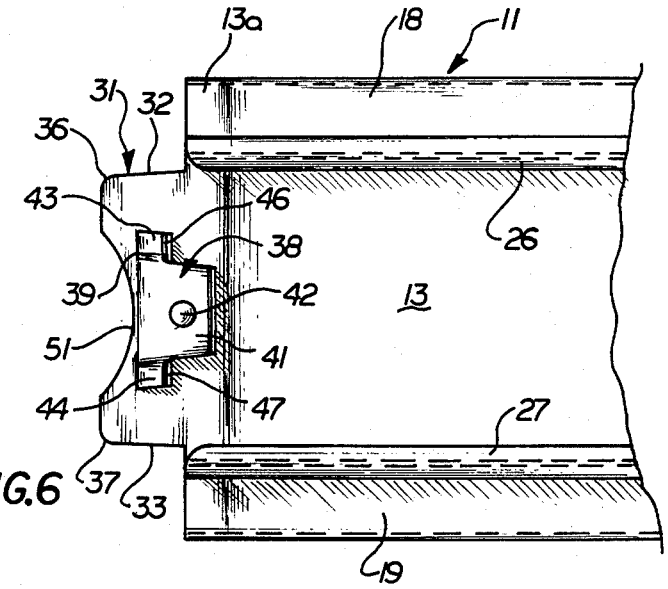
FIG. 6 is a plan view similar to FIG. 5, illustrating the end connector.

The end connector 31 projects from the end of the grid member, as best illustrated in FIG. 6, and provides opposite edges 32 and 33 which converge at a small angle so that adjacent to the extremity at 36 and 37 the width of the end connector is reduced a small amount to facilitate insertion of the end connector 31 into the slot 28.

Figure 7:
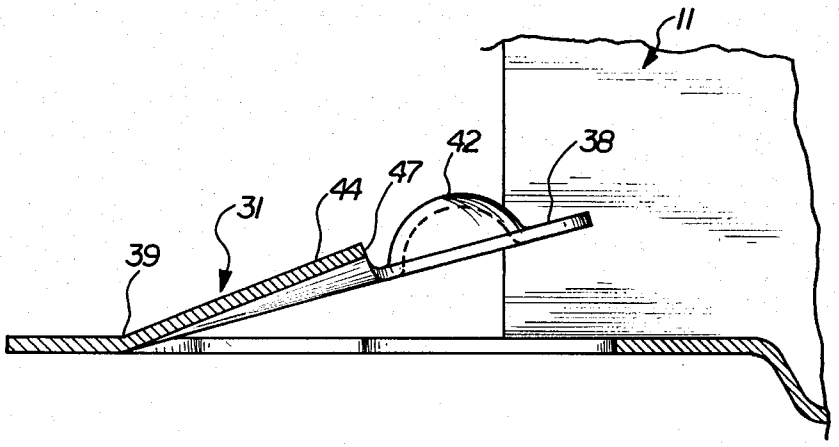
FIG. 7 is an enlarged, exploded, fragmentary view of the grid members, illustrating the connector parts before assembly.

Formed substantially along the center of the end connector is a lanced projection 38 which extends upwardly and rearwardly from a hinge line 39 at a relatively small angle. The lanced projection provides a central portion 41 having an upwardly extending dimple 42 formed therein along the centerline of the projection. Wing portions 43 and 44 are provided along the opposite lateral extremities of the lanced projection 38, and are deformed upwardly above the plane of the center portion of the lanced projection, as best illustrated in FIG. 7. The rearward edge of the wing portions 43 and 44 provide locking edges or surfaces 46 and 47, respectively, which are located above the plane of the center portion of the lanced projection and face in a rearward direction with respect to the grid member 11. In effect, the lanced projection is generally T-shaped with the top of the T joined to the remainder of the connector at the hinge line 39. The locking edges 46 and 47 are provided at the underside of the cross portion of the T, and the dimple 42 is formed in the stem of the T. The stem is narrower than the cross portion and extends rearwardly beyond the dimple to provide an extension for use in disconnecting the connector, as discussed below.

Adjacent to the end connector 31, the ends of the grid member 11 are deformed upwardly so that the ends of the face 13 at 13*a* can lap over the panel support flanges 19 of an associated through grid member 11, as illustrated in FIG. 7. This also offsets the male end connector 31 so that it can extend over the associated panel support flange and into the slot 28 formed in the adjacent web 24 or 23.

Figure 8:
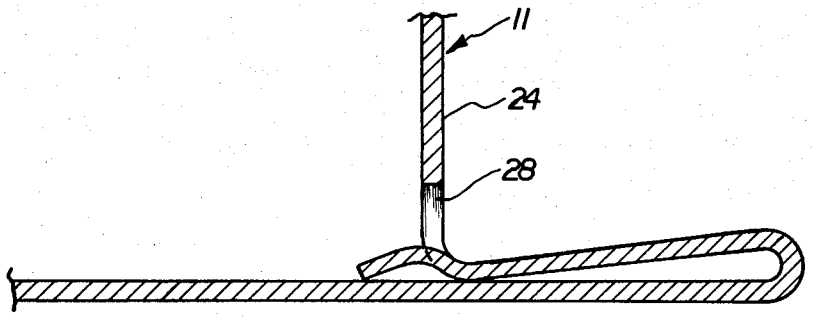
FIG. 8 is an enlarged, fragmentary view of the connector parts in their assembled position.
Figure 8:
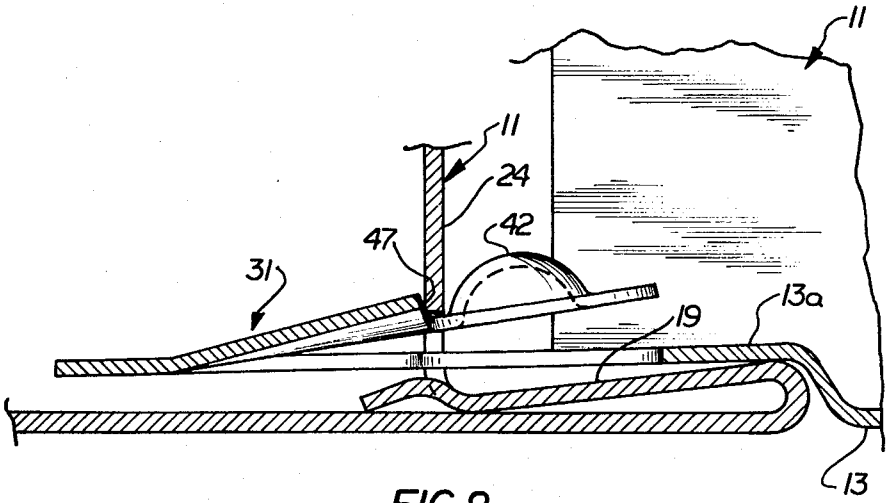

The material forming the male connector 31 has sufficient resiliency so that as the connector is pressed forward into the associated opening or slot 28, it is cammed down and resiliently deflected from its unstressed condition until the locking edges 46 and 47 pass the associated flange 23 or 24. The lanced projection then springs back up, as illustrated in FIG. 8, so that the locking edges or surfaces 46 and 47 engage the rearward side of the flange adjacent to the opening and prevent removal of the male connector 31.

In order to ensure proper assembly, it is important to form the wing portions 43 and 44 so that they extend above the lower surface of the lanced projection a distance which is at least as small as the height of the slot 28 and so that interference does not develop between such parts during insertion. On the other hand, to prevent the male connector 33 from being pressed too far through the slot, the height of the dimple 42 is arranged so that it exceeds the height of the slot and provides a positive stop to prevent over-insertion.

It should be noted that the two wing portions 43 and 44 and their associated locking edges 46 and 47 are spaced on opposite sides of the centrally located dimple 42. Therefore, if for some reason difficulty is encountered in causing the connector to lock up, an additional force in the direction of insertion of the male connector 31 causes additional force to be applied to the web at its center above the slot by the dimple, and causes the web to bow in a concave manner to increase the clearance at the locking edges so that locking up can be properly achieved in a reliable manner.

In the event that it is desired to disconnect the connection, it is a simple matter to merely press down on the rearward extension of the lanced projection to disengage the locking edges so that the male connecting portion 34 can be removed from the slot. Further reconnection, if required, is again accomplished by reinserting the end connector 31.

It is preferable to provide the end connector 31 so that it is substantially adjacent to the lower edge of the flange, as illustrated. When such structure is utilized, the connected structure is better able to withstand tension forces without excessive deflection of the web and opening of the joint. The illustrated structure also places the opposed connectors in direct alignment so there is no tendency for the connected, through-grid member to be rolled or twisted in any way in the event that tension forces are applied to the opposite sides thereof. Still further, because the slot is substantially aligned with the upper surface of the panel support flange, alignment for assembly is easily established. During assembly, the end connector 31 of the grid member is merely positioned on the panel support flange of the through-channel member, and vertical alignment for assembly is automatically achieved. Further, it is not necessary to raise the opposite end of the grid member to initiate insertion. Since the side edges of the connected member are inwardly tapered, alignment in a horizontal direction is not difficult to achieve.

In this illustrated embodiment, the forward edge of the end connector 31 is formed with a curved recess 51 which tends to localize the hinge line 39 and also provides clearance for accessories such as sprinkler heads or the like, which are often installed at intersections within a suspension ceiling of the type illustrated.

FIG. 9 illustrates a second embodiment of this invention in which the end connector is provided by a separable clip installed in the ends of the runners. In this embodiment, the runners are again provided with a lower planar surface 61 which extends to reverse bends at 62 and 63 and from the reverse bends to upstanding webs 64 and 66. Here again, the runner provides opposed flanges 67 and 68 which support ceiling panels and the like. In this particular embodiment, profile of the webs differs slightly from the first embodiment in that a short inwardly extending offset 69 is provided and the web above the offset 69 along the portion 71 is planar. At the top of the flanges, the runner material is bent inwardly to provide a short inwardly extending surface 72 substantially parallel to and spaced above the planar portion 61. From the inner end of the surface 72, the runner material extends downwardly a short distance along lips 74 which are spaced inwardly from the web portion 71 by a distance substantially equal to the width of the surface 72. A fold 73 is provided at the lower edge of each lip. The lips 74 provide a surface opposite the inner surface of the adjacent web portion 71 which is spaced a small distance therefrom.

An aperture 76 is formed in each web portion of the runners a short distance from the ends thereof to provide for locking of a connector clip 77. The connector clip 77 is generally U-shaped, providing a bottom wall 78 and two upstanding side walls 79 and 81. The clip is proportioned to slide into the end of the runner with its bottom wall 78 adjacent to the planar bottom surface 61 of the runner and the two upstanding side walls 79 and 81 substantially adjacent to the web portions 71. The height of the upstanding walls 79 and 81 is selected to provide upper edges 82 which fit closely adjacent to the lateral surface 72 between the web portion 71 and the depending lips 74. Therefore, the connector clip 77, when telescoped into the end of the runner, is restrained against all movement except longitudinal movement.

Each of the upstanding sidewalls 79 and 81 is provided with lanced projections 83 and 84 which provide opposed, axially facing edge portions 86 and 87, respectively. Such projections are deformed from the material of the upstanding walls and the projections 83 are shaped to provide a camming action so that they deflect the upstanding walls inwardly slightly and as the connector clip is telescoped into the end of the runner. When the projections 83 are aligned with the openings or apertures 78, they snap into the openings, causing the forward edges of the openings 76 to be in alignment with the edges 86 to prevent axial movement of the clip in a direction out of the runner. At the same time, an edge 87 is positioned in alignment immediately adjacent to the forward edge 88 of the webs. Therefore, the two projections cooperate to lock the end connector against relative axial movement in both directions.

The end of the bottom wall 78 extends forwardly from an upward offset 91 and provides an end connector of the same shape and structure as the end connector of the first embodiment. Therefore, the structural detail of such end connector 92 need not be repeated. The offset 91 is proportional so that the planar surfaces of the connected runners are coplanar.

When the runners are to be connected, the end connectors 92 are pressed into the associated slots formed in the walls of the intersecting runner, as described above. If the grid consisting of assembled runners is to be disassembled in its entirety, the connector can be released by depressing the locking structure in a manner described above so that the connector can slide out of the associated opening. However, with this embodiment it is also possible to remove a single runner even from a basket weave system by pressing the forward edges of the connector clip inwardly at the same time the rearward extension is depressed to release the connector itself.

When the upstanding forward edges of the upstanding walls are deflected inwardly, the edges 78 move out of alignment with the forward edges of the web portions 88 and the clip can be telescoped back into the runner, disconnecting the connection between the end of one runner and the through runner without moving the runner axially away from the through runner. Once the clip is disconnected, the runner end is raised or lowered out of alignment with the through runner. When it is desired to reconnect the elements, it is merely necessary to align the runners and slide the clip back out to its normal installed position. Because the wall 74 is spaced inwardly from the web portion a short distance, it does not prevent this deflecting movement of the forward end of the upstanding walls to release the clip for telescoping movement into the runner beyond its normally installed position. Further, since the walls 79 and 81 project beyond the web portions when the clip is installed, it is easy to deflect the walls inwardly to release the projections 84. With this embodiment it is possible to disconnect or remove individual runners from the grid without requiring relative longitudinal movement of one runner with respect to the other since once the end connector is telescoped back into the runner, the runner can be raised or lowered to a position which clears the adjacent through runner.

While the preferred embodiment of this invention is particularly adapted for use with wide-faced grids, within the broader aspects of this invention it may also be used in T-grid systems or the like.

Although the preferred embodiments of this invention have been shown and described, it should be understood that various modifications and rearrangements of the parts may be resorted to without departing from the scope of the invention as disclosed and claimed herein.

What is claimed is:

1. A suspension ceiling grid system comprising a plurality of elongated grid members providing a face portion and a pair of spaced webs extending therefrom, some of said members including logitudinally extending slots in said web at locations spaced from the ends thereof, some of said members also including end connectors providing upwardly extending resilient lock means, said end connectors being insertable through said slots, insertion of said end connectors through said slots deflecting said resilient lock means in a direction toward said face portion until an installed position is reached, said lock means being operable to engage the remote side of web to lock said members together in said installed position, said slots being formed substantially adjacent to said face portion so that tensile forces applied to said end connectors do not produce significant lateral deflection of the associated web.

2. A grid system as set forth in claim 1, wherein said face is a planar surface terminating in oppositely extending panel support flanges, and said slots are adjacent to said flanges whereby said end connectors are aligned with said slots when resting on said flanges.

3. A grid system as set forth in claim 1, wherein said slots are formed in both webs in alignment with each other, whereby aligned grid members are installable on opposite sides of an associated grid member.

4. A grid system as set forth in claim 1, wherein said lock means provide spaced locking surfaces operable to engage said web at longitudinally spaced locations along its length, and a stop engageable with said web on the side opposite said lock surfaces between said spaced locations, said stop operating to limit movement of said end connector in the direction of insertion.

5. A grid system as set forth in claim 4, wherein said resilient means includes a rearwardly extending lanced projection inclined back from a hinged line, said projection including spaced, raised wing portions providing said locking surfaces.

6. A grid system as set forth in claim 1, wherein said grid members are provided with similar end connectors at each end and laterally aligned slots formed in said web at a location midway between said ends, said grid members being installable in a basketweave grid assembly.

7. A grid system as set forth in claim 6, wherein said end connectors are formed with end cutouts which provide spacing between a pair of grid members installed in alignment on opposite sides of an associated grid member to provide clearance for an accessory such as a sprinkler head or the like.

8. A grid system as set forth in claim 1, wherein said end connectors are integrally formed from the material forming said face portion.

9. A grid system as set forth in claim 1, wherein said slots are aligned with the upper surface of said panel support flanges, whereby an end connector resting on an associated panel support flange is vertically aligned with associated slots for insertion therein, said panel support flange adjacent the ends of said members being displaced upwardly to fit over associated flanges of a connected member.

10. A grid system as set forth in claim 1, wherein said end connectors are provided by a separate clip telescoping with some of said members, said clip and said some of said members providing opposed interengaging surfaces axially locating said clips in an installed position relative to said some of said members in which said end connector extends beyond the end thereof, said clip being deflectable to release said opposed surfaces and allow telescoping movement of said clip along said some of said members in a direction away from the associated end thereof to remove said end connector from said slot without corresponding relative movement of said some of said members.

11. A grid system as set forth in claim 10, wherein said clip is generally U-shaped providing two spaced sidewalls joined by a central wall, said sidewalls and said webs each providing said opposed surfaces, said sidewalls and said webs being laterally deflectable relative to each other to permit release to said opposed surfaces.

12. A grid system as set forth in claim 11, wherein said sidewalls extend beyond said webs when said clip is in said installed position.

13. A locking connector for suspension ceiling grid systems or the like having intersections, including first members connected at their ends to perpendicularly extending second members extending through said intersection, said members providing oppositely extending, planar panel support flanges adjacent to the lower surface and a vertically extending web extending upwardly from said flanges, said second members providing an elongated slot in said web extending along the length thereof substantially adjacent to the plane of said flanges, said first members providing end connectors projecting from the ends thereof along a plane adjacent to the plane of said flanges and proportioned to be inserted through an associated slot, said end connectors providing rearwardly facing locking means resiliently biased to a position above the plane thereof and operable to engage the side of said web and to lock said first and second members together.

14. A grid system as set forth in claim 13, wherein said rearwardly facing locking means provides opposed surfaces operable when positioned in said slot to engage both sides of said web and prevent relative axial movement in both directions.

15. A grid system as set forth in claim 14, wherein said opposed surfaces include laterally spaced wings providing a pair of rearwardly facing locking surfaces, and a raised projection located rearwardly from and substastially midway between said locking surfaces.

16. A grid system as set forth in claim 15, wherein said locking means provide an extending portion operable when depressed to release said locking surfaces for disassembly of said grid members.

17. A grid system as set forth in claim 13, wherein said grid members provide laterally spaced, substantially parallel webs and said webs are provided with aligned slots whereby opposed first members are connected in alignment on opposite sides of said second member.

18. A connector structure for suspension ceiling grid systems or the like, comprising elongated grid members providing a face portion and an upstanding web portion, slots in said web portion extending lengthwise thereof, and a male end connector proportioned to extend through said slot and lock said members together, said male end connector providing a planar portion and a rearwardly extending generally T-shaped lanced projection, said lanced projection being joined to said planar portion along a hinge line at the top of the T, and being inclined back and away from said planar portion, the underside of the cross portion of said T being displaced from the plane of said T to provide rearwardly extending, raised lock surfaces operable to engage the remote side of an associated web when said male connector is inserted into said slot, said lanced portion providing a stem portion extending back through said slot when said connector is inserted therein, said stem portion when depressed releasing said lock surfaces for disconnecting said connectors.

19. A connector structure as set forth in claim 18, wherein a stop is provided on said stem portion to limit insertion of said male connector into said slot.

20. A connector structure as set forth in claim 18, wherein said raised lock surfaces are deformed from said plane of said T by a distance less than the lateral width of said slot whereby said lock surfaces can be inserted into said slot without interference.

21. A suspension ceiling grid system comprising a plurality of elongated runners adapted to be interconnected at intersections in which each intersection includes a first runner extending through said intersection and a second runner connected at its end to sid first runner, said runners providing panel supporting flanges and an upstanding web, said web of said first runner providing an opening therein, a connector clip telescoping with said second runner, said clip and said second runner providing opposed interengaging locking surfaces normally locking said clip in an installed position and against axial movement relative to said runner, said clip providing an end connector extending beyond the end of said second runner insertable through said opening to lock said runners together at said intersection, said opposed locking surfaces being movable by deflection to a disengaged position to allow telescoping movement of said clip axially relative to said second runner in a direction wasy from said end of said first runner to remvoe said end connector from said opening without corresponding movement of said second runner relative to said first runner.

22. A grid system as set forth in claim 21, wherein said second runners are provided with spaced substantially parallel webs, said clip being generally U-shaped and providing spaced and substantially parallel walls, said walls each engaging an associated web, said opposed interengaging locking surfaces being provided by said walls and webs, said walls and webs being laterally deflectable relative to each other to disengage said locking surfaces for telescoping movement of said clip relative to said second runner.

23. A grid system as set forth in claim 22, wherein one of each wall and associated web provide camming surfaces to permit telescoping movement of said clip relative to said second runner except when said clip is in said installed position.

24. A grid system as set forth in claim 22, wherein said walls provide projecting portions projecting beyond said webs when said clip is in said installed position, lateral forces applied to said projecting portions operating to disengage said locking surfaces.

25. A grid system as set forth in claim 24, wherein each web is provided with an aperture spaced from the end thereof and each wall is provided with a first lanced projection positioned in an associated aperture when said clip is in said installed position.

26. A grid system as set forth in claim 25, wherein each wall is provided with a second lanced projection engaging the end of an associated web when said clip is in said installed position.

27. A suspension ceiling grid system comprising a plurality of elongated runners providing a face portion terminating in opposed panel supporting flanges, a pair of spaced and substantially parallel webs extending substantially perpendicular to said face portion from the inner edges of said flanges, U-shaped connector clips telescoping into said runners at the ends thereof, said clips providing a base portion and a pair of spaced substantially parallel walls positioned against the inner surfaces of said webs, said webs providing longitudinal slots adjacent to an associated flange, said clips providing a connector portion extending from said base beyond the adjacent end of said runners and insertable through said slots to releasably lock said runners together to form a grid, said clips being movable axially relative to said ends of said runners to withdraw said connector portion from an associated slot without corresponding movement of said runners.

28. A grid system as set forth in claim 27, wherein said clips and runners provide opposed interengaging locking surfaces releasably locking said clips in an installed position in which said connector portion extends beyond the end of the associated of said runners.

* * * * *

UNITED STATES PATENT AND TRADEMARK OFFICE

CERTIFICATE OF CORRECTION

PATENT NO. : 4,492,066

DATED : January 8, 1985

INVENTOR(S) : Paul D. LaLonde

It is certified that error appears in the above—identified patent and that said Letters Patent is hereby corrected as shown below:

IN THE CLAIMS

Claim 1, Column 6, line 61, "logitudinally" should read as "longitudinally".

Claim 15, Column 8, line 33, "substastially" should read as "substantially".

Claim 21, Column 9, line 23, "wasy" should read as "away".

Claim 21, Column 9, line 24, "remvoe" should read as "remove".

Signed and Sealed this

*Seventh* Day of *May 1985*

[SEAL]

*Attest:*

DONALD J. QUIGG

*Attesting Officer* *Acting Commissioner of Patents and Trademarks*